US008714772B1

(12) United States Patent
Levante et al.

(10) Patent No.: US 8,714,772 B1
(45) Date of Patent: May 6, 2014

(54) LED STRIP LIGHT CONNECTOR SYSTEM

(71) Applicant: Inspired LED, LLC, Tempe, AZ (US)

(72) Inventors: James J. Levante, Tempe, AZ (US); Tanner J. Leland, Tempe, AZ (US)

(73) Assignee: Inspired LED, LLC, Tempe, AZ (US)

( * ) Notice: Subject to any disclaimer, the term of this patent is extended or adjusted under 35 U.S.C. 154(b) by 0 days.

(21) Appl. No.: 13/766,981

(22) Filed: Feb. 14, 2013

Related U.S. Application Data

(60) Provisional application No. 61/670,710, filed on Jul. 12, 2012.

(51) Int. Cl.
*H01R 12/24* (2006.01)

(52) U.S. Cl.
USPC ..... 362/217.17; 362/249.02; 362/249.01; 362/237; 439/210

(58) Field of Classification Search
USPC ..... 362/217.17, 249.02, 249.03, 249.04; 439/67, 76.1, 418
See application file for complete search history.

(56) References Cited

U.S. PATENT DOCUMENTS

| | | | | |
|---|---|---|---|---|
| 4,808,113 | A | 2/1989 | Kanesige | |
| 5,308,262 | A | 5/1994 | Chishima | |
| 5,370,552 | A | 12/1994 | Chishima | |
| 5,559,681 | A * | 9/1996 | Duarte | 362/231 |
| 5,863,217 | A | 1/1999 | Ii | |
| 6,004,156 | A | 12/1999 | Roque | |
| 8,262,250 | B2 | 9/2012 | Li | |
| 8,517,759 | B1 * | 8/2013 | Brown | 439/492 |

OTHER PUBLICATIONS

ElementLED, multi-color-rgb-led-strip-to-strip connector—posted on web Dec. 31, 2010.* http://www.elementalled.com/pdf/EL-STRPSPLC.pdf; Product Information Sheet from Elemental LED, LLC; Received and Downloaded on Jan. 13, 2013.

http://www.elementalled.com/pdf/EL-BVSTRPCON2.pdf; Product Information Sheet from Elemental LED, LLC; Received and Downloaded on Jan. 13, 2013.

http://www.globalconnectortechnology.com/ffc-connectod; Webpage for Global Connector Technology; Received and Printed on Jan. 13, 2013.

http://www.gct.co/ffc-connector/pdf/FFC3B10.pdf; Product Drawing from Global Connector Technology; Recieved and Downloaded on Jan. 13, 2013.

http://www.globalconnectortechnology.com/ffc-connector/ffc-connectors.aspx; Webpage of FFC Connectors from Global Connector Technology; Received and Printed on Jan. 13, 2013.

http://multimedia.3m.com/mws/mediawebserver?66666UuZjcFSLXTtlXTyLxfyEVuQEcuZgVs6EVs6E666666--; Webpage for 3M Tapes; Received and Printed on Jan. 16, 2013.

* cited by examiner

*Primary Examiner* — Tracie Y Green
(74) *Attorney, Agent, or Firm* — Michael S. Neustel

(57) ABSTRACT

A LED strip light connector system for providing a reliable connection between a flexible LED light strip and a connector. The LED strip light connector system generally includes a connector adapted to receive an end of a light strip, and a support member extending outwardly from the connector to support the light strip near the connector. The light strip is attached to the surface of the support member thereby preventing movement of the light strip with respect to the connector.

20 Claims, 17 Drawing Sheets

LED STRIP LIGHT CONNECTOR SYSTEM

CROSS REFERENCE TO RELATED APPLICATIONS

I hereby claim benefit under Title 35, United States Code, Section 119(*e*) of U.S. provisional patent application Ser. No. 61/670,710 filed Jul. 12, 2012. The 61/670,710 application is currently pending. The 61/670,710 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an electric terminal and more specifically it relates to a LED strip light connector system for providing a reliable connection between a flexible LED light strip and a connector.

2. Description of the Related Art

Any discussion of the related art throughout the specification should in no way be considered as an admission that such related art is widely known or forms part of common general knowledge in the field.

Light strips, such as flexible LED light strips, have become increasingly popular in various applications such as but not limited to under cabinet lighting, TV back lighting, staircase lighting, architectural lighting, bar lighting, kitchen lighting, toe kick lighting, ceiling cove lighting, decorations and vehicles. A flexible LED light strip is comprised of a flexible strip of material, a plurality of light-emitting diodes (LED) attached along the front surface of the flexible strip of material, and a length of adhesive along the back surface of the flexible strip. The LEDs may emit the same light or may change colors to provide a range of light options. Most conventional flexible LED light strips utilize a low-voltage 12V DC electrical power.

During installation of flexible LED light strips, at least one end of the flexible LED light strip is physically and electrically connected to a connector (e.g. DC power coupler, splice connector, etc.). The end of the flexible LED light strip may be attached by soldering the LED light strip to the connector. However, soldering is time consuming combined with the fact that some consumers simply do not have a soldering iron or have the desire to solder components together.

Solderless connectors have been introduced into the marketplace to eliminate the need for soldering the light strip to a connector. For example, flat flexible cable (FFC) connectors are one solderless solution that efficiently connects a light strip to a connector. With a FFC connector, the LED light strip is physically secured within a clasp (a.k.a. clam shell connector), a flip lock structure or a slide lock structure. U.S. Pat. No. 6,004,156 illustrates an exemplary FFC connector. With conventional connectors, soldered and solderless, there is no support structure to prevent movement of the light strip with respect to the connector and only the actual connection supports the light strip.

One of the problems with conventional connectors for flexible LED light strips is that over a period of time forces (e.g. direct forces, vibration, etc.) applied to the connector and/or the light strip can result in the failure of the electrical connection between the light strip and the connector. The failure of the flexible LED light strip can require costly maintenance for a consumer and disappointed customers for a business that installed the LED light strips. Another problem with conventional flexible LED light strips is that installation can be difficult and time consuming for the average consumer.

Because of the inherent problems with the related art, there is a need for a new and improved LED strip light connector system for providing a reliable connection between a flexible LED light strip and a connector.

BRIEF SUMMARY OF THE INVENTION

The invention generally relates to a flexible flat light strip connector which includes a connector adapted to receive an end of a light strip, and a support member extending outwardly from the connector to support the light strip near the connector. The light strip is attached to the surface of the support member thereby preventing movement of the light strip with respect to the connector.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
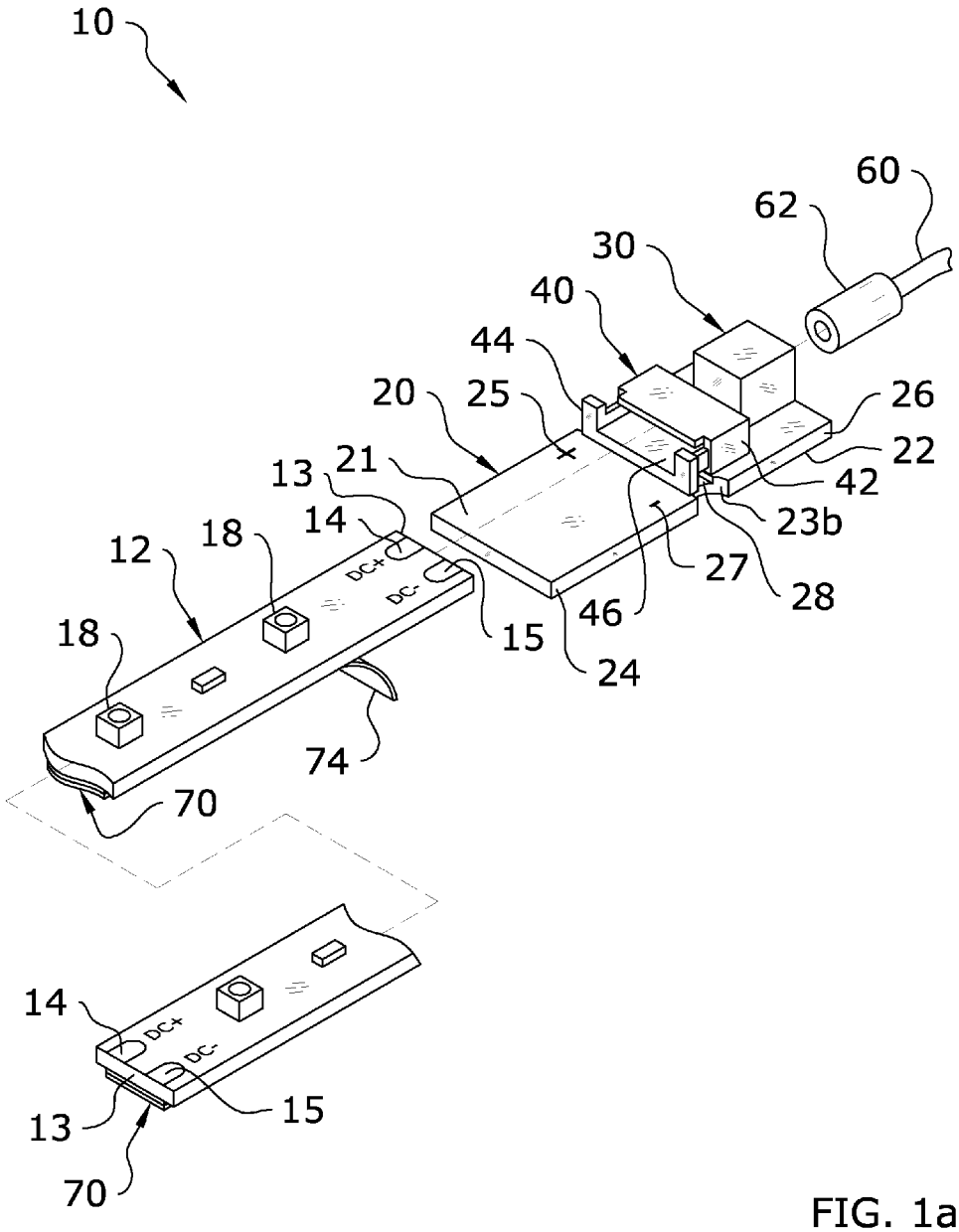
FIG. 1*a* is a front upper perspective view of the present invention with a light strip and a power cord disconnected from the connector.

Turning now descriptively to the drawings, in which similar reference characters denote similar elements throughout the several views, FIGS. 1 through 15 illustrate a LED strip light connector system 10, which comprises a connector adapted to receive an end of a light strip 12, and a support member 20 extending outwardly from the connector to support the light strip 12 near the connector. The light strip 12 is attached to the surface of the support member 20 thereby preventing movement of the light strip 12 with respect to the connector. A first adhesive strip 50 comprised of a first adhesive layer 52 and a first cover 54 is preferably attached to the second surface 22 of the support member 20 for mounting the support member 20 to an object such as but not limited to cabinets.

B. Light Strip

Figure 1B:
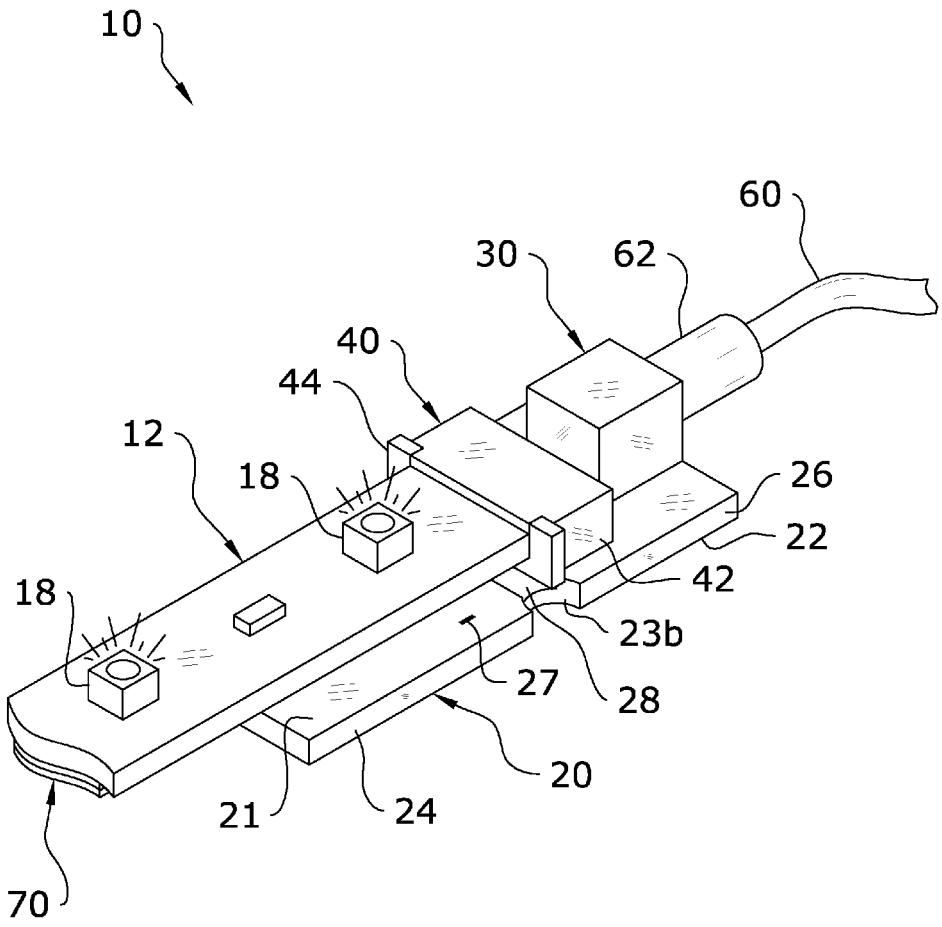
FIG. 1*b* is a front upper perspective view of the present invention with a light strip and a power cord connected to the connector.
Figure 2:
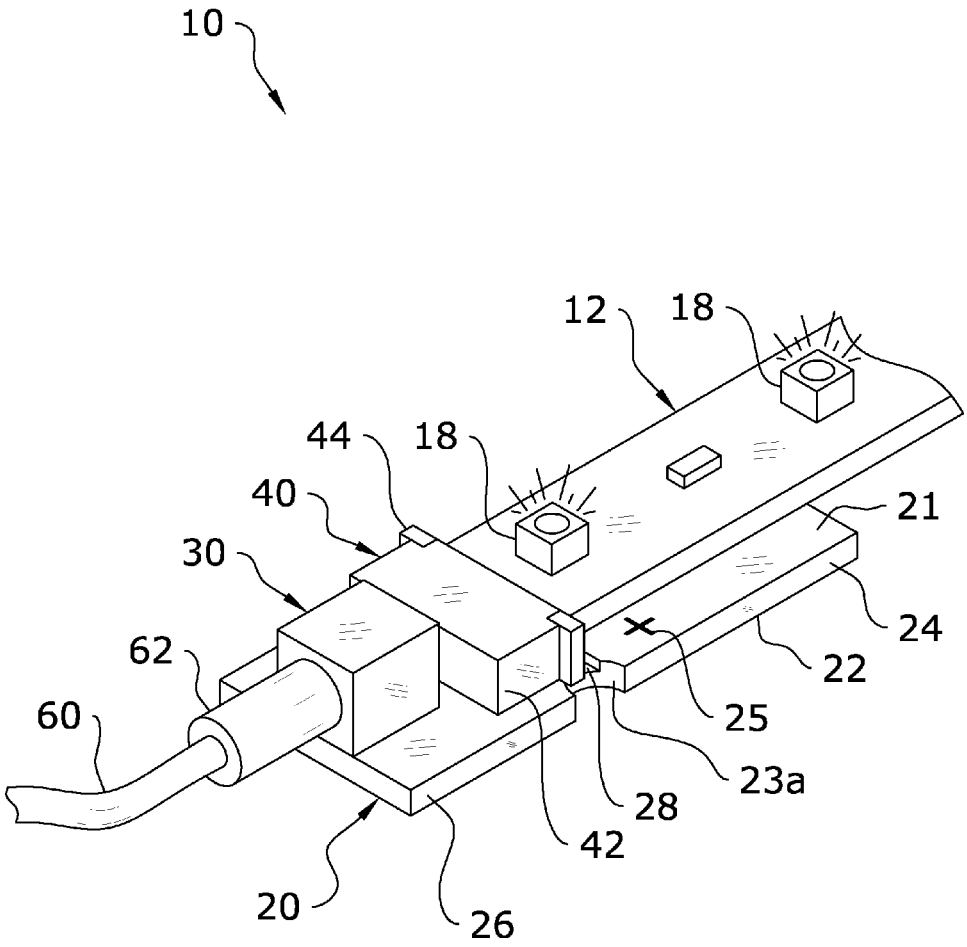
FIG. 2 is a rear upper perspective view of the present invention with a light strip and a power cord connected to the connector.

FIGS. 1*a* through 2 illustrate a portion of an exemplary light strip 12 having at least one connecting end 13 and a plurality of light sources 18. The light strip 12 may be comprised of various lengths (e.g. 1 foot, 6 feet, 12 feet) and widths. The width of the light strip 12 is preferably less than 0.5 inches which is typical for conventional light strips 12. Both ends of the light strip 12 may also be comprised of connecting ends 13 capable of electrically connecting to a connector. The light strip 12 is preferably flat and flexible. The light strip 12 may be comprised of a structure that may be cut to various lengths.

For a light strip 12 having a single color of light being emitted, the connecting end 13 includes a first contact 14 and a second contact 15 for electrically connecting to an electrical connector 29, 40. The first contact 14 and the second contact 15 are electrical connectors (e.g. metal contacts) that are electrically connected to the plurality of light sources 18 of the light strip 12. If the light strip 12 is adapted to provide different colors of lights, then additional contacts may be included within the connecting end 13.

The light strip 12 is comprised of a plurality of light sources 18 attached to the light strip 12 that emit light. The light sources 18 may provide a single color of light or a plurality of colors. The light sources 18 may be comprised of the same color or different colors. The light sources 18 may be distally spaced apart at various distances to provide for a desired lighting effect. The light sources 18 are preferably comprised of light-emitting diodes, however, other types of light sources 18 may be utilized such as but not limited to incandescent light bulbs.

The light strip 12 preferably utilized within the present invention is comprised of a flexible LED light strip 12 wherein the light sources 18 are comprised of light-emitting diodes. The light strip 12 further is comprised of a flexible and flat structure with the LEDs extending from the flat flexible strip. In particular, the light strip 12 is preferably comprised of a non-conductive substrate strip that is flexible and flat. A non-conductive substrate strip includes an electrical circuit that is electrically connected to the contacts 14, and the light sources 18. The non-conductive substrate strip is preferably less than 1 mm in thickness. U.S. Pat. No. 8,262,250 to Lie et al. illustrates an exemplary flexible LED light strip 12 suitable for usage within the present invention and is hereby incorporated by reference herein.

Figure 6:
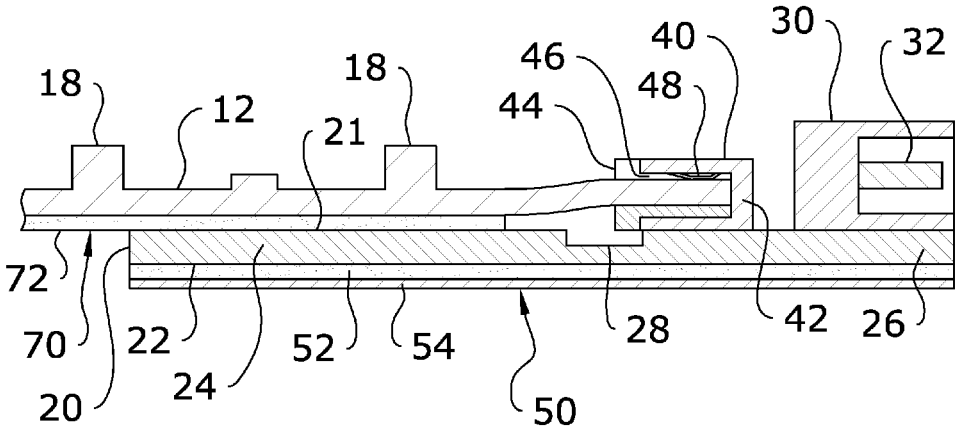
FIG. 6 is a cross sectional view taken along line 6-6 of FIG. 5.

The light strip 12 preferably includes a second adhesive strip 70 attached to the light strip 12 on a side of the non-conductive substrate strip opposite of the plurality of light sources 18 as illustrated in FIGS. 1*a*, 1*b*, 6 of the drawings. The second adhesive strip 70 is utilized to secure the light strip 12 to various surfaces (e.g. cabinets). In addition, a portion of the second adhesive strip 70 is utilized to secure the light strip 12 to the first support portion 24 of the support member 20 as illustrated in FIG. 6. The second adhesive strip 70 may be comprised of various adhesive strips such as peel-off adhesive strips comprised of a second adhesive layer 72 and a second cover 74 (e.g. double-sided tape). The second adhesive strip 70 may be comprised of an adhesive transfer tape that has a thickness of less than 1 mm such as the 3M HIGH PERFORMANCE ADHESIVE TRANSFER TAPE WITH ADHESIVE 200 MP manufactured by 3M COMPANY. Alternatively, a separate adhesive not part of the light strip 12 may be applied between the backside of the light strip 12 and the first surface 21 of the support member 20 to secure a portion of the light strip 12 to the first support portion 24.

C. Support Member

FIGS. 1*a* through 15 illustrate the support member 20 comprised of a rigid platform having a first surface 21, a second surface 22, a first support portion 24 and a second support portion 26. The second support portion 26 extends to approximately the front face of the solderless connector 40 where the light strip 12 enters the solderless connector 40 as shown in FIG. 3 of the drawings.

Figure 3:
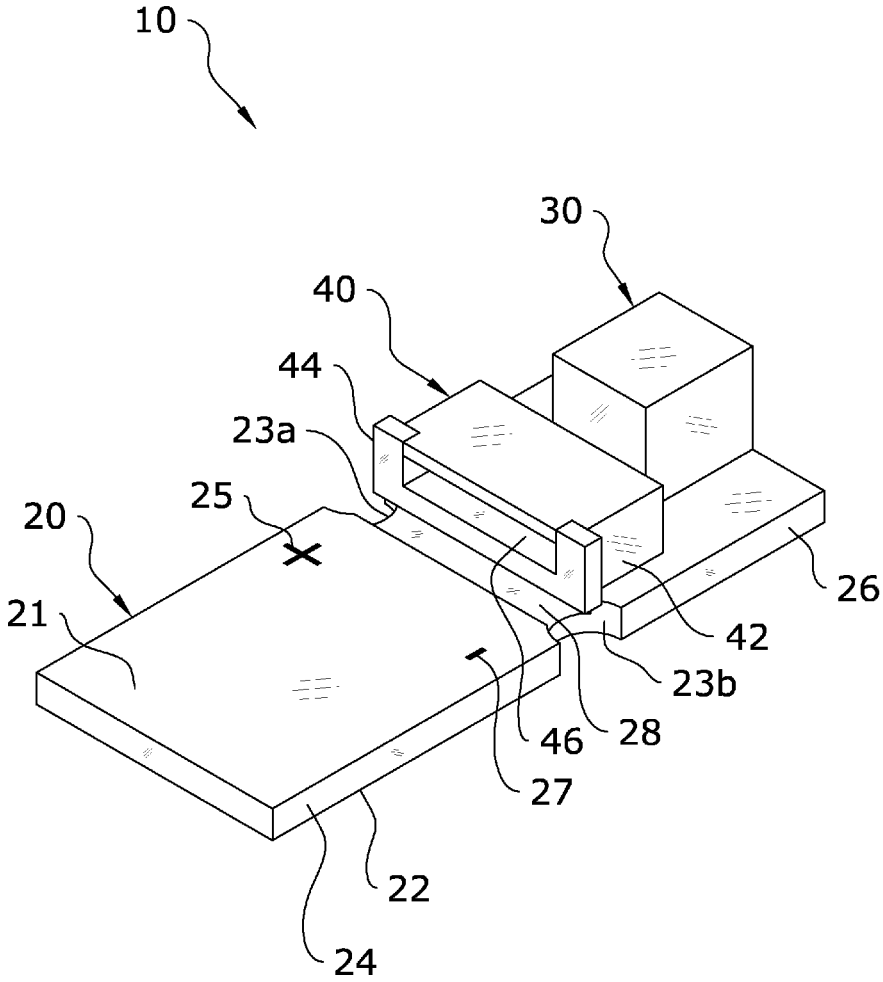
FIG. 3 is a front upper perspective view of the present invention.

It is preferable to have a recessed portion 28 extending crosswise with respect to the longitudinal axis of the support member 20 in front of the solderless connector 40 when using a solderless connector 40 having a sliding lock structure to allow for the sliding lock to go below the first surface 21 as illustrated in FIG. 3 of the drawings. A pair of cutouts 23*a*, 23*b* preferably extend into the sides of the support member 20 between the first support portion 24 and the second support portion 26 to allow for manual grasping and manipulation of the sliding lock of the solderless connector 40 as further shown in FIGS. 3, 5 and 9*a* of the drawings. The cutouts 23*a*, 23*b* are adjacent the solderless connector 40 and may have various shapes such as circular, curved, rectangular and the like.

The support member 20 is preferably comprised of a planar structure and is configured to receive and support the various connectors 30, 40. The support member 20 is preferably constructed of a rigid material that is significantly more rigid than the light strip 12 to provide support to the light strip 12 with respect to the electrical connector 29, 40. The support member 20 is preferably comprised of a printed circuit board having circuitry that electrically connects the connectors attached to the support member 20. The printed circuit board is comprised of a sheet of dielectric material with the circuitry integrated within. The support member 20 preferably has a thickness of less than 2 mm, however, greater or less thicknesses for the support member 20 may be utilized. In a preferred embodiment, the support member 20 is comprised of a thickness of approximately 1.5 mm. The support member 20 preferably is comprised of a consistent thickness throughout the support member 20, however, the support member 20 may have varying thicknesses. With a printed circuit board used for the support member 20, the support member 20 preferably integrates system level components within the printed circuit board such as but not limited to occupancy sensors, timers, dimmers, switches, diode bridges, voltage regulators and control modules 80.

Figure 5:
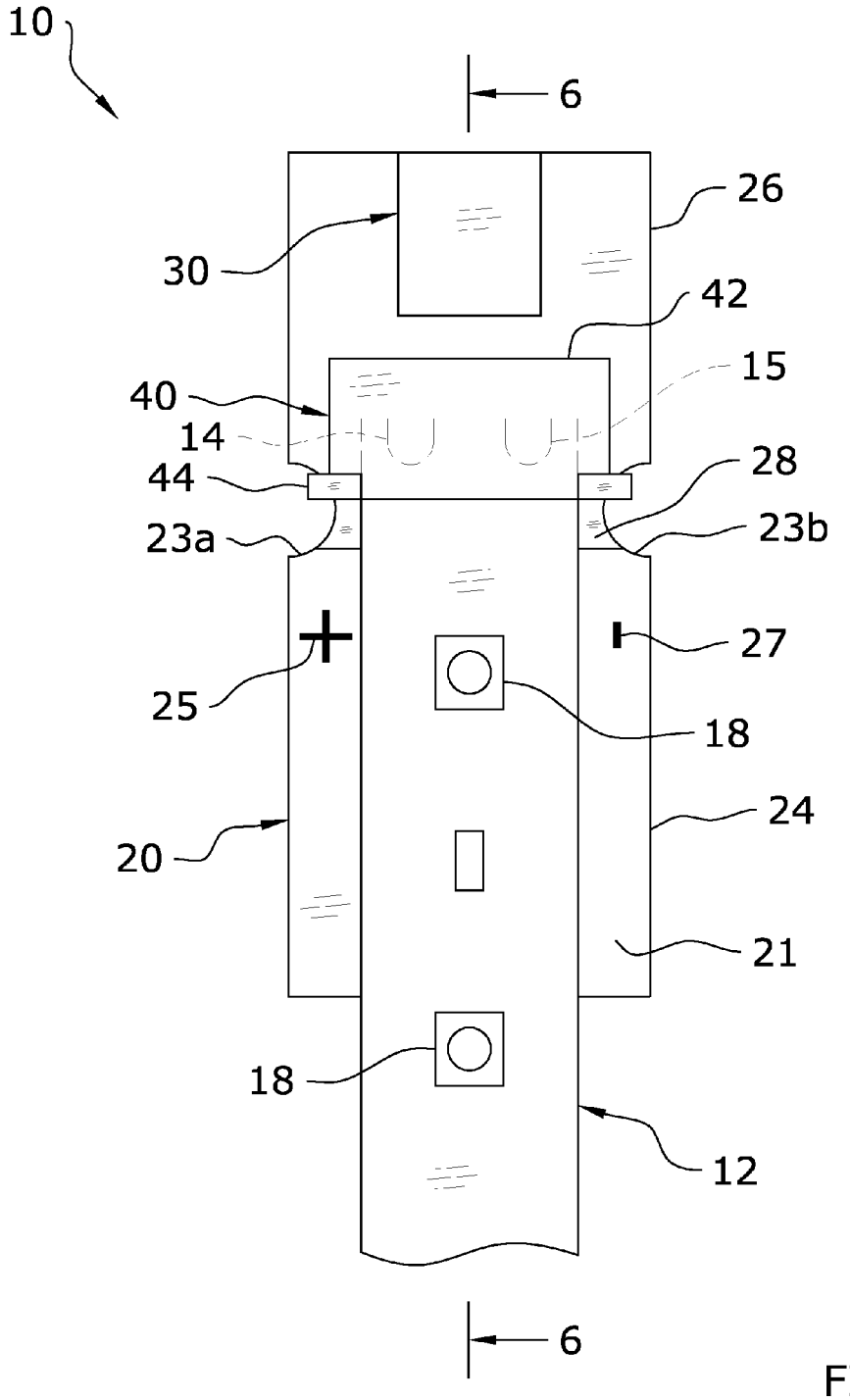
FIG. 5 is a top view of the present invention with a light strip connected.
Figure 9A:
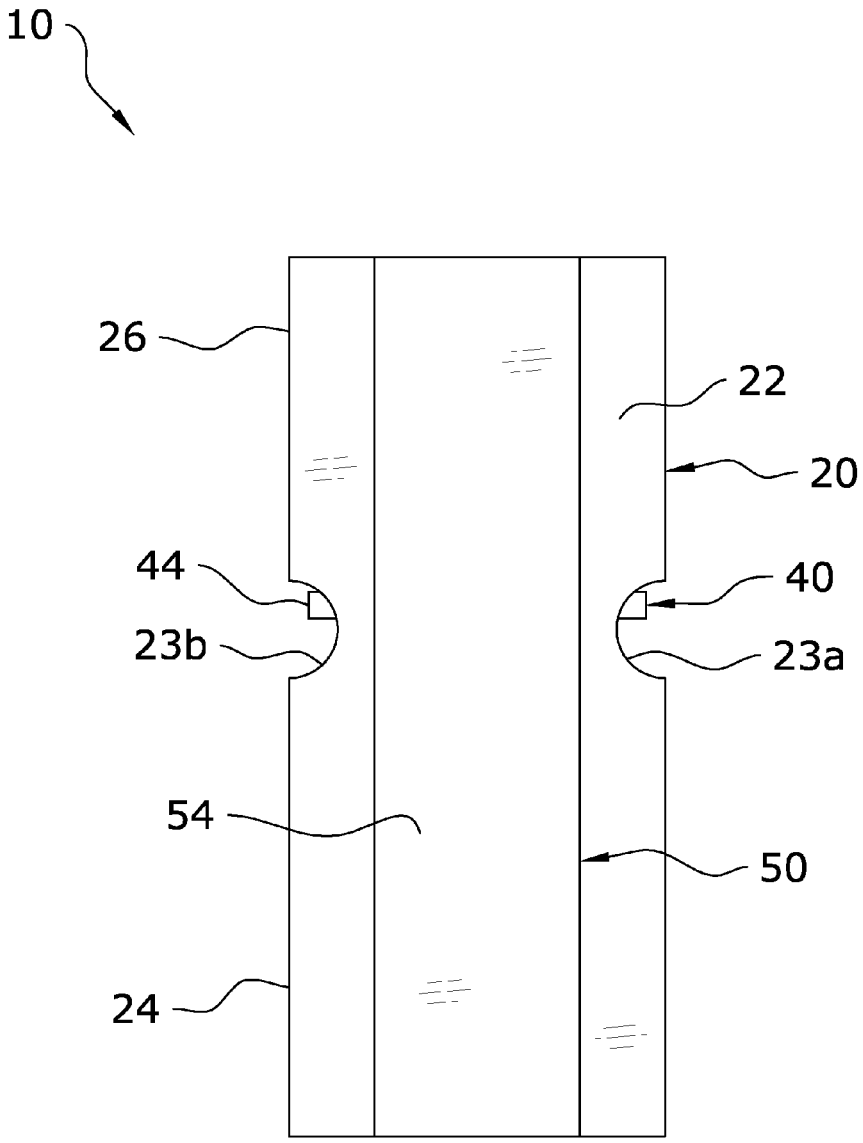
FIG. 9*a* is a bottom view of the present invention.
Figure 9B:
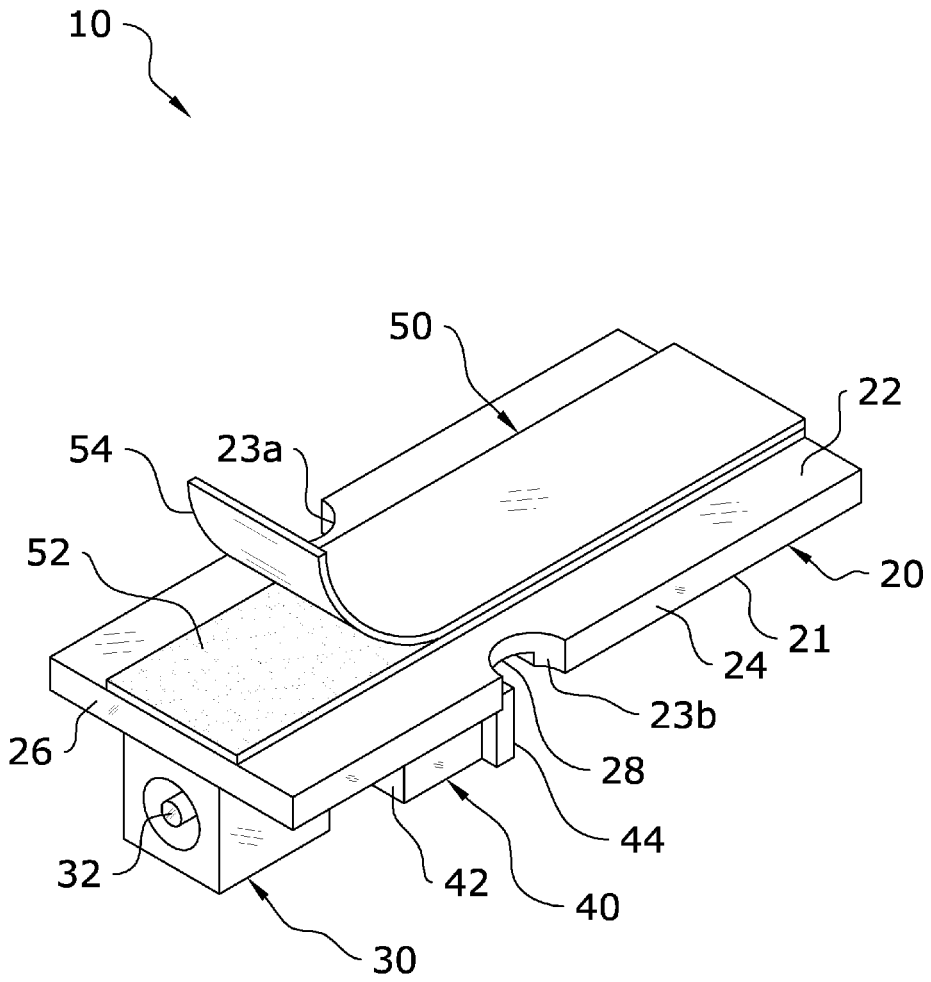
FIG. 9*b* is an upper perspective view of the present invention inverted showing the adhesive and the cover removably attached to the adhesive.

The support member 20 is preferably comprised of an elongated structure having a longitudinal axis. The support member 20 preferably has a rectangular shape as best illustrated in FIG. 9*a* of the drawings. The length of the first support portion 24 is preferably greater than the length of the second support portion 26 measured along the longitudinal axis of the support member 20 (with the longitudinal axis passing through line 6-6 of FIG. 5). In particular, the length of the first support portion 24 is preferably at least two times larger than the width of the first support portion 24. The width of the support member 20 is preferably approximately equal to or greater than the width of the solderless connector 40 as illustrated in FIG. 5 of the drawings. In the preferred embodiment, the length of the support member 20 is approximately 48 mm and the width of the support member 20 is 17 mm. The first support portion 24 is preferably approximately 28 mm and the second support portion 26 is preferably approximately 20 mm.

As illustrated in FIGS. 1*a* through 4 of the drawings, the first support portion 24 extends outwardly away from the first connector and away from the second support portion 26. The first support portion 24 and the second support portion 26 are preferably comprised of unitary structure, however, the first support portion 24 may be attached to the second support portion 26.

D. Polarity Indicia

Most light strips 12 utilized with the present invention utilized a DC power supply (e.g. 12V DC, 24V DC). To assist the person installing the light strips 12, it is preferable that the first surface 21 of the support member 20 includes one or more DC voltage polarity indicia 25, 27 adjacent to a side of the solderless connector 40 to indicate the DC voltage polarity alignment for the solderless connector 40 as illustrated in FIGS. 1*a* and 3 of the drawings.

In particular, it is preferable to have a positive indicia 25 indicated by a symbol (e.g. "+") or text (e.g. "Positive") adjacent to the side of the solderless connector 40 that has the positive polarity connected to the DC power supply. In particular, it is preferable to have a negative indicia 27 indicated by a symbol (e.g. "−") or text (e.g. "Negative") adjacent to the side of the solderless connector 40 that has the negative polarity connected to the DC power supply and opposite of the positive polarity. The polarity indicia 25, 27 may be applied to the support member 20 may engraving, etching, painting, drawing or other well-known system for creating a visible indicia on the support member 20.

The connecting end 13 of the light strip 12 typically will have one or more polarity indicia such as "DC+" or "DC−" that the installer will align with the DC voltage polarity indicia 25, 27 on the support member 20 as illustrated in FIG. 1*a* of the drawings. The user utilizes the polarity indicia 25, 27 to identify how to align the light strip 12 prior to connecting to the connector 29, 40.

E. DC Connector

FIG. 1*a* illustrates a connector for connecting to a light strip 12 and a power coupler 30 for connecting to a DC power supply attached to the support member 20, wherein the connector is comprised of a solderless connector 40. The solderless connector 40 is electrically connected to the power coupler 30 to provide electrical power to the light strip 12 when the connecting end 13 of the light strip 12 is positioned within and secured within the solderless connector 40. It is preferable that the solderless connector 40 and the power coupler 30 are attached to the first surface 21 of the support board.

Figure 4:
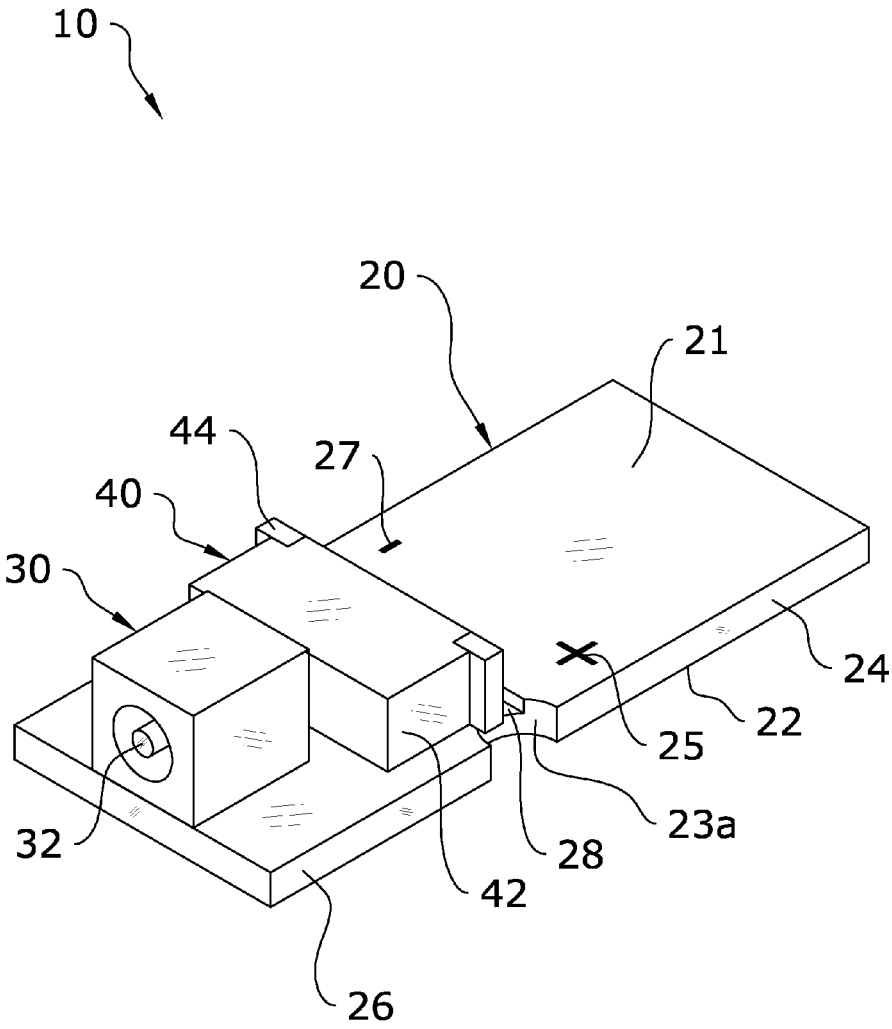
FIG. 4 is a rear upper perspective view of the present invention.
Figure 7A:
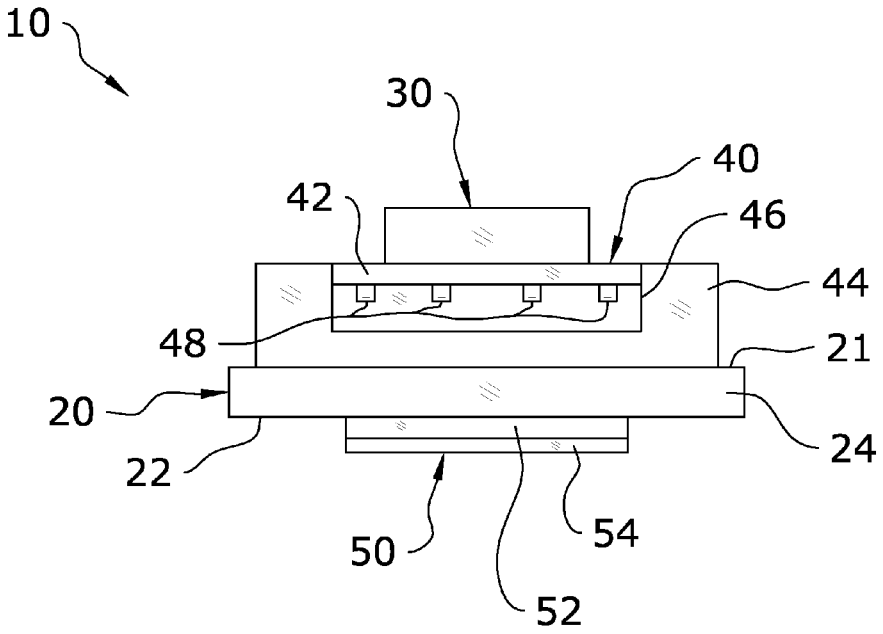
FIG. 7*a* is a front end view of the present invention.
Figure 7B:
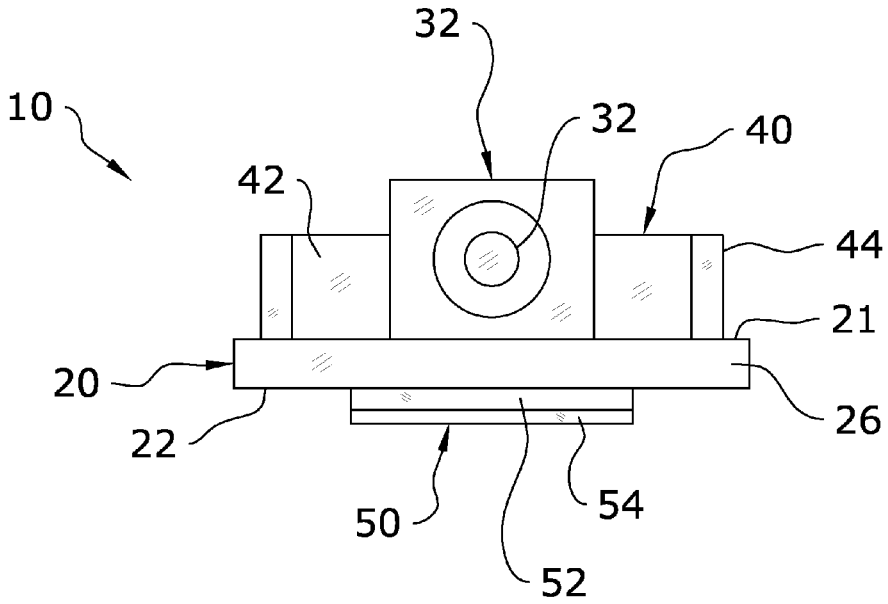
FIG. 7*b* is a rear end view of the present invention.
Figure 8A:
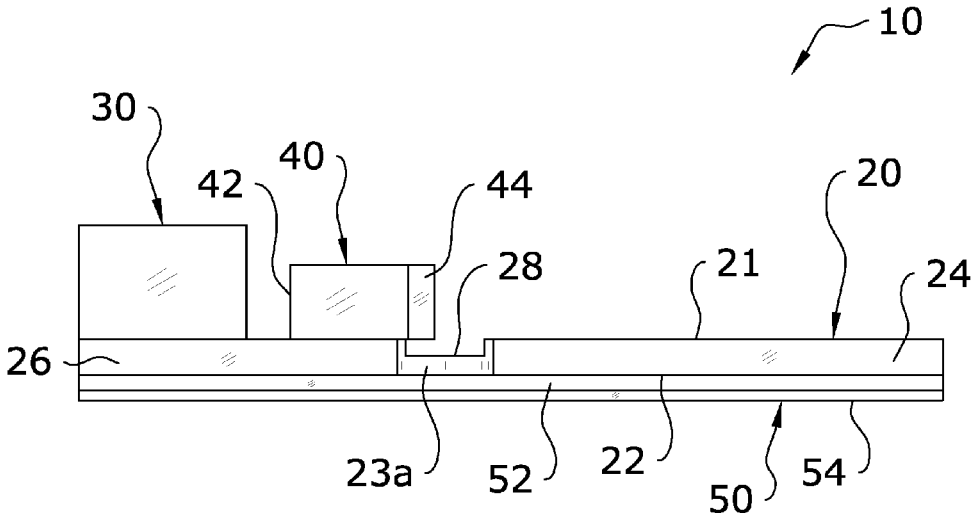
FIG. 8*a* is a left side view of the present invention
Figure 8B:
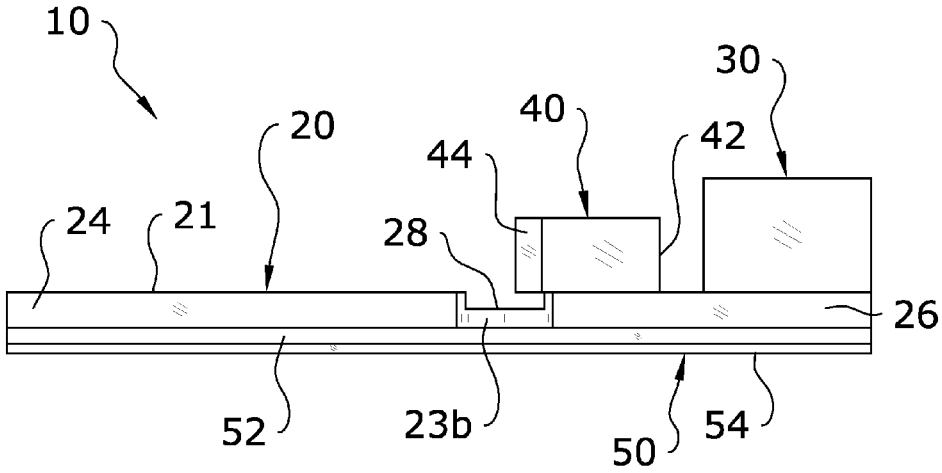
FIG. 8*b* is a right side view of the present invention.

The power coupler 30 may be comprised of any type of DC connector. FIGS. 4 and 7*b* illustrates the power coupler 30 having a power receptacle 32 that receives a power coupler 30 from a power cord 60. The power cord 60 is electrically connected to a DC power supply (e.g. an AC/DC converter; battery pack). It can be appreciated that the DC connector may be comprised of various other types of connectors such as but not limited to a Tamiya connector, a Molex connector, a Deans connector, SAE connector, MC4 single pole DC connectors and the like.

F. Solderless Connector

FIGS. 1*a* through 7*a* best illustrate the solderless connector 40 for electrically connecting and physically connecting to the connecting end 13 of the light strip 12. The solderless connector 40 does not require soldering to connect the light strip 12 to the solderless connector 40.

A preferred solderless connector 40 is comprised of a flat flexible cable (FFC) connector (e.g. clam shell connector, flip lock structure, slide lock structure, etc.). FIGS. 1*a* through 7 illustrate a slide lock type of solderless connector 40 that is comprised of a housing 42, a connector opening 46 within the housing 42 to receive the connecting end 13 of the light strip 12, a locking member 44 that is slidably positioned within the housing 42 and interior connectors 48 within the housing 42 that are electrically connected to the DC connector. The connector opening 46 of the solderless connector 40 faces along a longitudinal axis of the support member 20 so that the light strip 12 may be substantially centered on the first support portion 24 as illustrated in FIGS. 1*a*, 1*b* and 5 of the drawings.

When the locking member 44 is moved outwardly as shown in FIG. 1*a* of the drawings, the connecting end 13 of the light strip 12 may be freely inserted into the solderless connector 40. When the locking member 44 is moved inwardly as shown in FIG. 1*b* of the drawings, the connecting end 13 of the light strip 12 is secured within the solderless connector 40 and electrically connected to the interior connectors 48. U.S. Pat. No. 6,004,156 illustrates a solderless connector 40 suitable for use within the present invention and is hereby incorporated by reference herein.

Various other solderless connectors 40 may be utilized within the present invention to electrically connect to a light strip 12 without requiring soldering.

G. Soldered Connection

Figure 14:
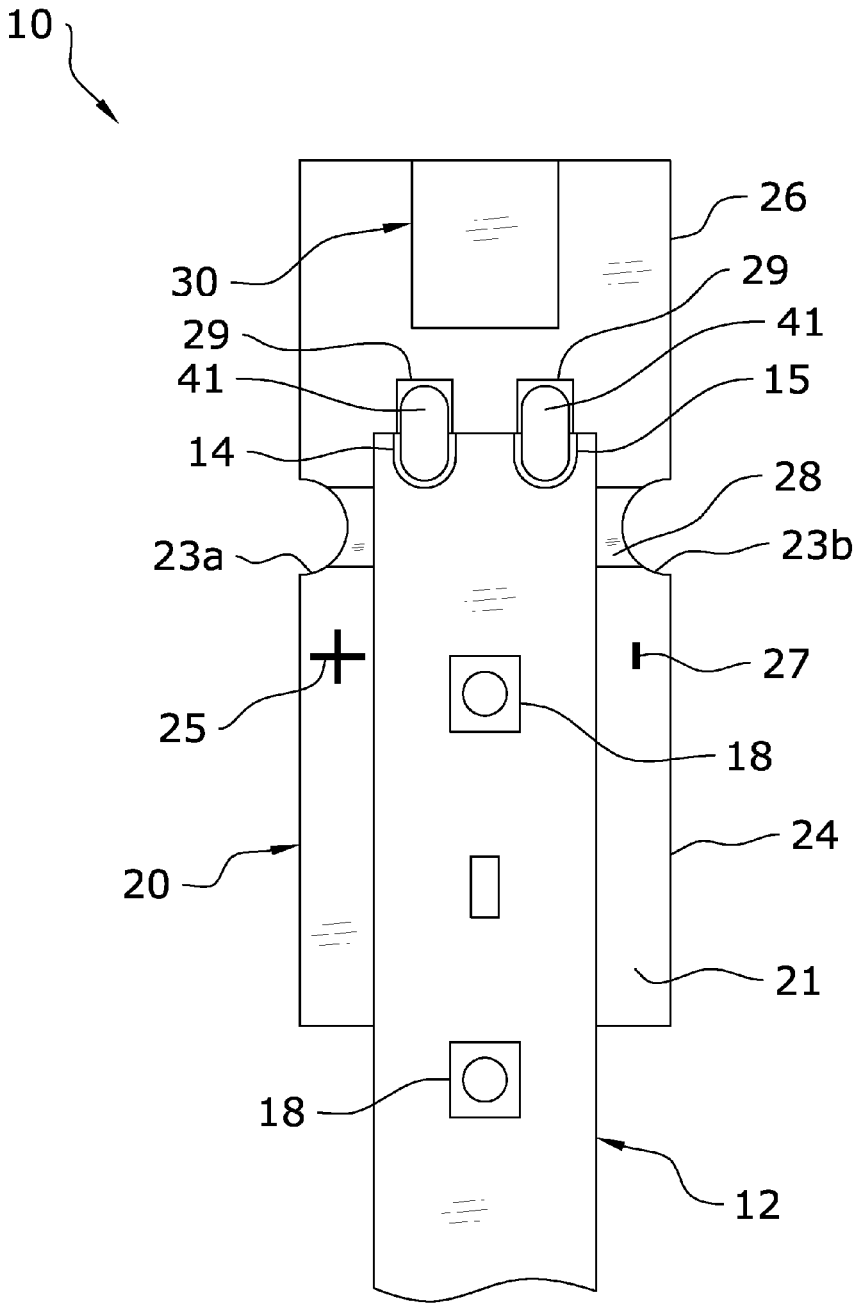
FIG. 14 is a top view of an alternative embodiment of the present invention utilizing a solder joint to connect the light strip instead of a solderless connector.

While a solderless connector 40 is preferable, a soldered connection may also be utilized as illustrated in FIG. 14 of the drawings. In the soldered connection, at least two electrical contacts 29 that are adapted to have a corresponding pair of solder joints 41 connect to the connecting end 13 of the light strip 12 as shown in FIG. 14 of the drawings. The solder joints 41 may be applied to the contacts 14, 15 of the light strip 12 and the electrical contacts 29 of the support member 20. As shown in FIG. 14 of the drawings, the light strip 12 is attached to the first support portion 24 of the support member 20 along the longitudinal axis of the support member 20 similar to the connection with a solderless connector 40.

H. Control Module

Figure 11:
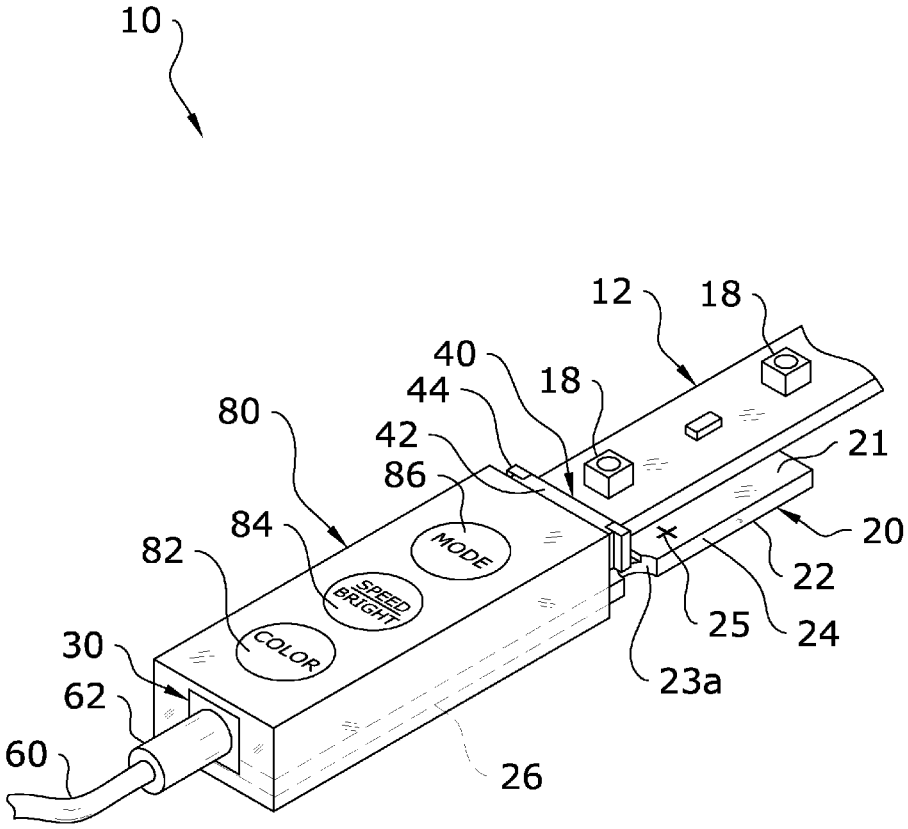
FIG. 11 is an upper perspective view of an alternative embodiment of the present invention with a control module for controlling operation of the light strip.
Figure 15:
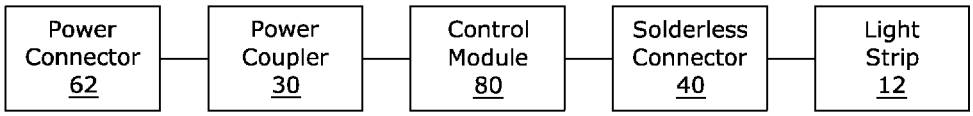
FIG. 15 is a block diagram illustrating the electrical communication between the components of the invention shown in FIG. 11 with the control module.

FIGS. 11 and 15 illustrate the usage of a control module 80 attached to the support member 20 and electrically positioned between the solderless connector 40 and the power coupler 30. The control module 80 may be a module attached to the support member 20 or built into the support member 20. The control module 80 preferably includes one or more buttons 82, 84, 86 that allow for the control of the electrical power to the light strip 12 for performing various functions such as turning on/off the power to the light strip 12, changing a light pattern, changing the color of the light sources 18, and various other functions utilized with light strips 12. The control module 80 may have no buttons and may have a USB or RF input for inputting control commands from the user. The control module 80 includes circuitry within that allow for the electrical control of the light strip 12 as desired.

I. Alternative Variations

A plurality of support members 20 may be utilized either attached to one another or formed from a unitary structure to provide for a splice connector that allows for the connection of two or more light strips 12 together. Below some alternative variations of the present invention are discussed. As can be appreciated, additional variations of the present invention are capable and the following should not limit the scope of the claims.

Figure 10:
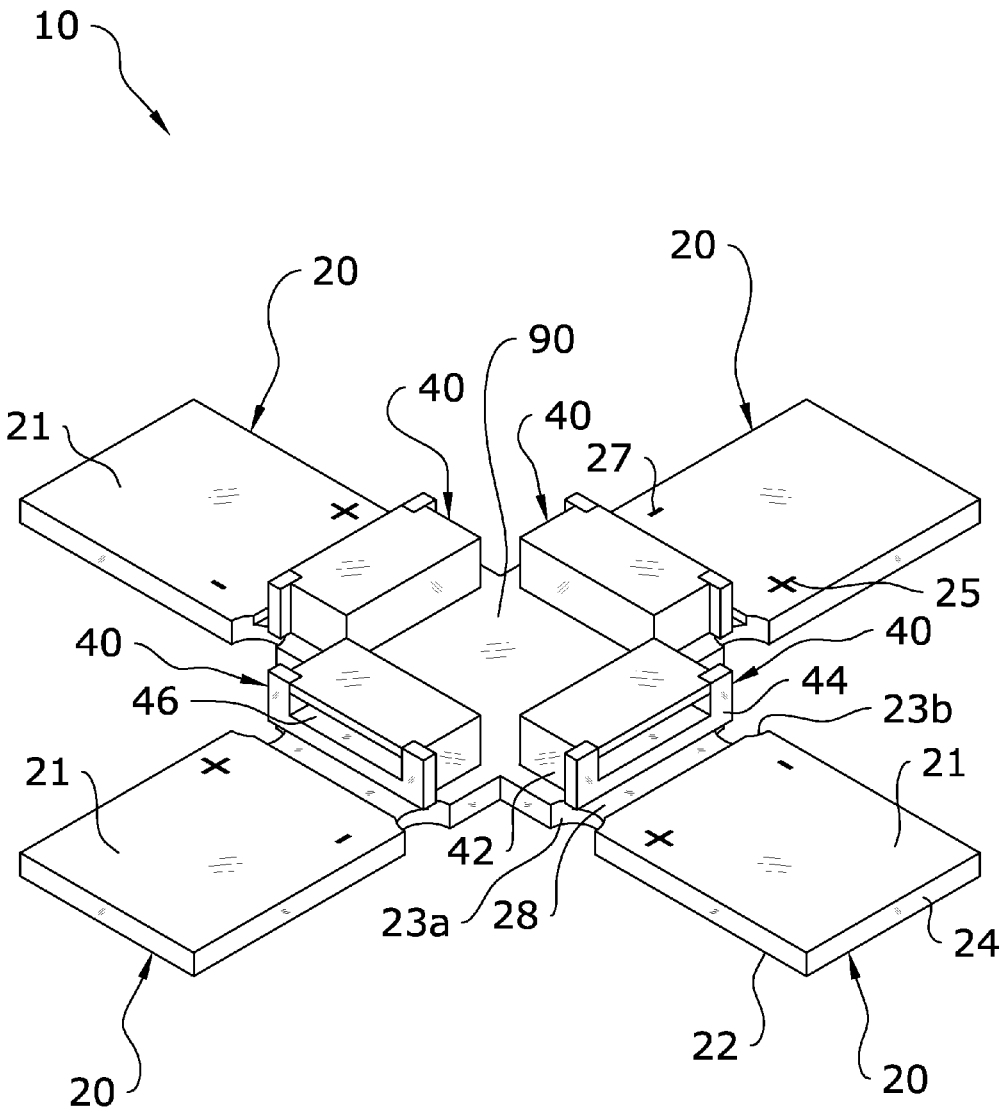
FIG. 10 is an upper perspective view of an alternative embodiment of the present invention forming a splice connector for connecting up to four light strips.
Figure 12:
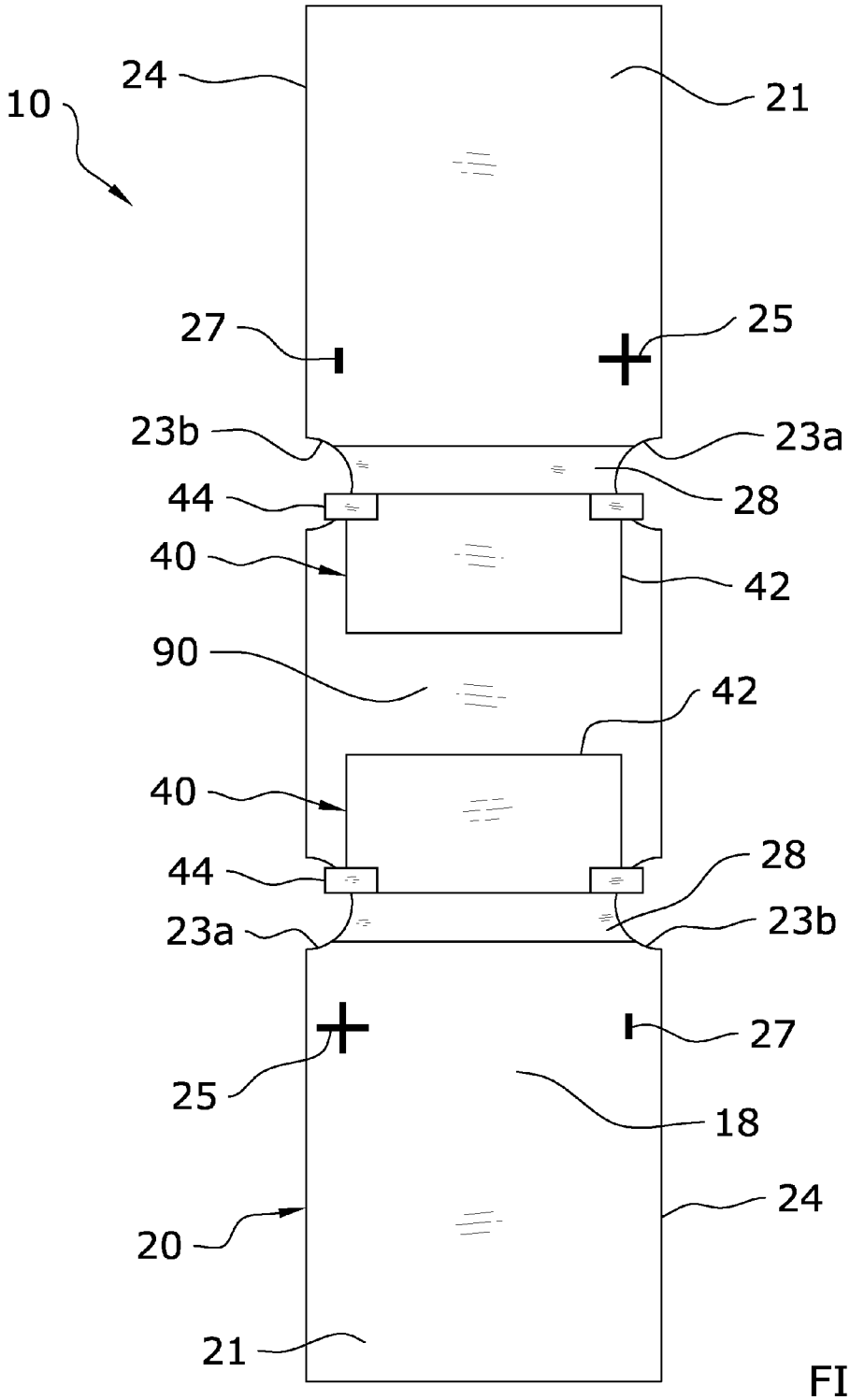
FIG. 12 is a top view of an alternative embodiment of the present invention forming a splice connector for connecting two light strips.

FIG. 12 illustrates a splice connector comprised of two solderless connectors 40 facing away from one another with two first support portions 24 extending away from a central support 90 that the solderless connectors 40 are connected to. When a first light strip 12 is connected to the first solderless connector 40 and a second light strip 12 is connected to the second solderless connector 40, the two lights trips are electrically connected in series to one another thereby allowing sharing of the same power supply. It can be appreciate that three, four, five or more solderless connectors 40 may be utilized on the same support platform. For example, FIG. 10 illustrates a the usage of four solderless connectors 40 attached to the central support 90 comprised of four support members 20 extending outwardly in a cross shape and wherein the four solderless connectors 40 are all electrically connected together.

Figure 13:
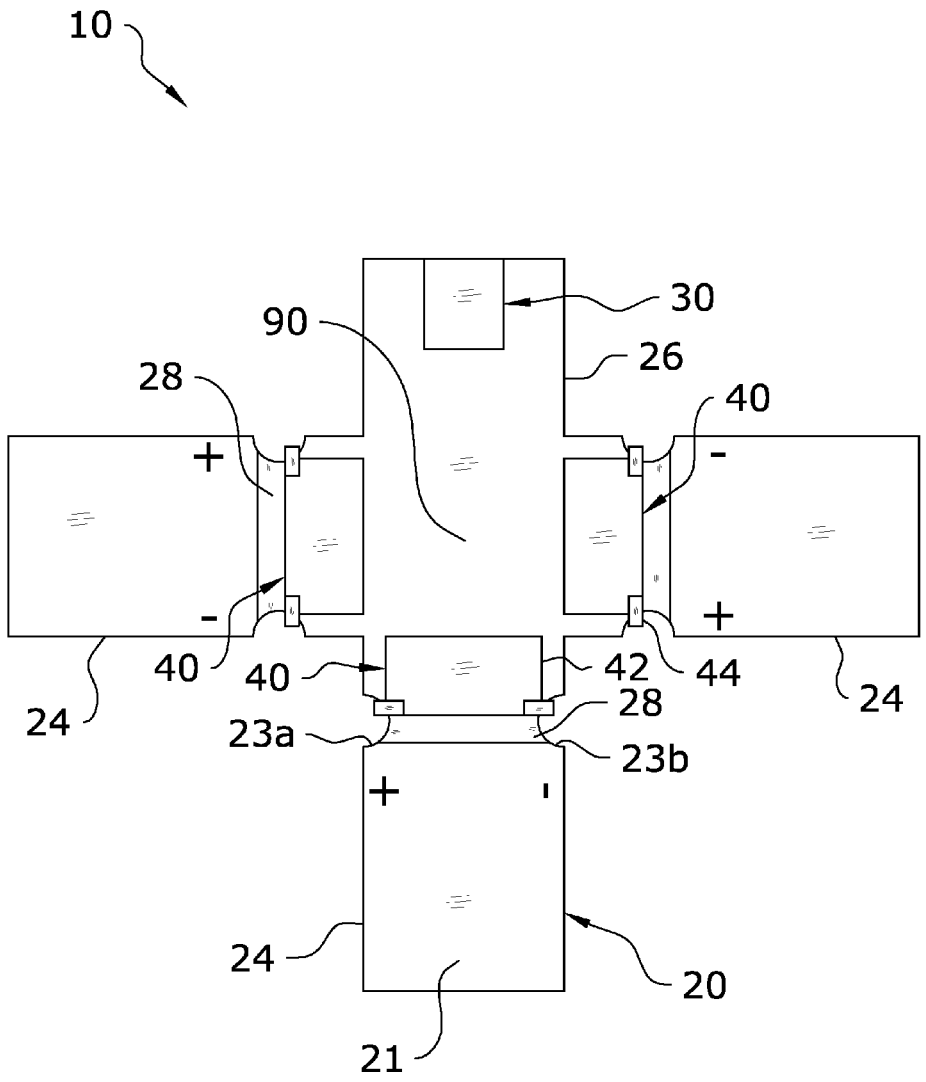
FIG. 13 is a top view of an alternative embodiment of the present invention forming a DC power coupler for connecting up to three light strips.

FIG. 13 illustrates the usage of three solderless connectors 40 attached to three support members 20 on the same support platform, wherein the three solderless connectors 40 are electrically connected to a power coupler 30. Two or more solderless connectors 40 may be utilized on a power coupler 30 platform similar to the system shown in FIG. 13.

J. Operation of Preferred Embodiment

In use, the user releases the solderless connector 40 to allow for the positioning of the light strip 12 within as illustrated in FIG. 1*a* of the drawings. The second cover 74 of the second adhesive strip 70 is removed from the connecting end 13 of the light strip 12 to expose the second adhesive layer 72 as illustrated in FIG. 1*a*. The user then inserts the connecting end 13 of the light strip 12 into the connector opening 46 of the solderless connector 40 and then secures the connecting end 13 within the solderless connector 40 by moving the locking member 44 as shown in FIG. 1*b* of the drawings. The user further presses upon the light strip 12 so the second adhesive layer 72 adjacent to the first surface 21 of the support member 20 securely attaches to the first surface 21 thereby preventing movement of the light strip 12 with respect to the solderless connector 40. When the power coupler 30 is electrically connected to a DC power supply, the light sources 18 on the light strip 12 illuminate as further shown in FIGS. 1*b* and 2 of the drawings. The opposing connecting end 13 of the light strip 12 may be connected to another solderless connector 40 (e.g. a splice connector configuration) to allow for electrical connection of a second light strip 12 or a jumper cable that connects to a power connector 62 to provide electrical power for one or more light strips 12.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A light strip connector, comprising:

a support member having a first surface, a second surface and a first support portion;

a first connector attached to said first surface of said support member, wherein said first connector is adapted to receive a connecting end of a light strip and wherein said first connector is positioned adjacent to said first surface of said first support portion;

wherein said first support portion extends outwardly away from said first connector; and a second connector attached to said support member, wherein said second connector is electrically connected to said first connector.

2. The light strip connector of claim 1, wherein said support member is comprised of a planar structure.

3. The light strip connector of claim 1, wherein said support member is comprised of an elongated structure having a longitudinal axis.

4. The light strip connector of claim 1, wherein said first support portion extends outwardly away from said first connector and said second connector.

5. The light strip connector of claim 1, wherein said support member includes a second support portion extending away from said first support portion, wherein said second connector is attached to said second support portion.

6. The light strip connector of claim 5, wherein said first support portion and said second support portion are comprised of unitary structure.

7. The light strip connector of claim 1, wherein said second connector is attached to said first surface.

8. The light strip connector of claim 1, including an adhesive strip attached to said second surface of said support member.

9. The light strip connector of claim 1, wherein said first support portion has a length and a width, wherein said length is at least two times larger than said width.

10. The light strip connector of claim 1, wherein said first connector is comprised of a solderless connector.

11. The light strip connector of claim 10, wherein said first connector is comprised of a flat flexible cable connector.

12. The light strip connector of claim 11, wherein said flat flexible cable connector is comprised of a sliding lock structure.

13. The light strip connector of claim 1, wherein said first connector is comprised of at least two electrical contacts that are adapted to have a corresponding pair of solder joints connect to the connecting end of the light strip.

14. The light strip connector of claim 1, wherein said support member includes a pair of cutouts on opposing sides of said support member adjacent said first connector.

15. The light strip connector of claim 1, wherein said second connector is comprised of a DC power coupler.

16. The light strip connector of claim 1, including a secondary support member connected to said support member, wherein said secondary support member includes a third connector, wherein said third connector is electrically connected to said first connector and said second connector.

17. A light strip connector, comprising:

a light strip, wherein said light strip is comprised of a flexible light-emitting diode strip having a connecting end and a plurality of light-emitting diodes;

a support member having a first surface, a second surface and a first support portion;

a first connector having a receiver opening adapted to receive said connecting end of said light strip;

wherein said first connector is attached to said first surface of said support member;

wherein said receiver opening of said first connector faces towards said first support portion of said support member;

wherein said first support portion extends outwardly away from said first connector; and wherein said light strip is attached to said first surface of said first support portion and wherein said connecting end is positioned within said receiver opening of said first connector.

18. The light strip connector of claim 17, wherein said support member is comprised of a planar structure.

19. The light strip connector of claim 17, wherein said first support portion has a length and a width, wherein said length is at least two times larger than said width.

20. A light strip connector, comprising:

a support member having a first surface, a second surface, a first support portion and a second support portion;

wherein said support member is comprised of a planar structure;

wherein said support member is comprised of an elongated structure having a longitudinal axis;

wherein said first support portion has a length and a width, wherein said length is greater than said width;

wherein said first support portion and said second support portion are comprised of unitary structure;

a first connector attached to said first surface of said support member, wherein said first connector is adapted to receive a connecting end of a light strip and wherein said first connector is positioned adjacent to said first surface of said first support portion;

wherein said first connector is comprised of a flat flexible cable connector; and a second connector attached to said support member, wherein said second connector is electrically connected to said first connector;

wherein said second support portion extends away from said first support portion, wherein said second connector is attached to said second support portion;

wherein said first support portion extends outwardly away from said first connector;

wherein said first surface of said support member includes at least one polarity indicia adjacent to a side of said first connector to indicate the DC voltage polarity alignment for said first connector.

* * * * *